US009611113B2

(12) United States Patent
Sasaki et al.

(10) Patent No.: US 9,611,113 B2
(45) Date of Patent: Apr. 4, 2017

(54) FLANGE, HOLDING DEVICE FOR HOLDING ROLL MEDIUM, AND RECORDING DEVICE FOR PERFORMING RECORDING ON ROLL MEDIUM

(71) Applicant: Seiko Epson Corporation, Tokyo (JP)

(72) Inventors: Tsuneyuki Sasaki, Matsumoto (JP); Junya Kato, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/874,571

(22) Filed: Oct. 5, 2015

(65) Prior Publication Data

US 2016/0101637 A1 Apr. 14, 2016

(30) Foreign Application Priority Data

Oct. 9, 2014 (JP) ..... 2014-207784

(51) Int. Cl.

| | |
|---|---|
| ***B41J 15/16*** | (2006.01) |
| ***B65H 16/06*** | (2006.01) |
| ***B65H 18/02*** | (2006.01) |
| ***B65H 75/18*** | (2006.01) |

(52) U.S. Cl.
CPC ..... *B65H 16/06* (2013.01); *B65H 75/185* (2013.01)

(58) Field of Classification Search
CPC ..... B41H 15/16; B65H 16/06; B65H 18/028
See application file for complete search history.

(56) References Cited

U.S. PATENT DOCUMENTS 6,561,453 B1 * 5/2003 Shinga ..... B65H 16/06 242/578.2

FOREIGN PATENT DOCUMENTS

JP 2013-112475 A 6/2013

* cited by examiner

*Primary Examiner* — Stephen Meier
*Assistant Examiner* — Alexander D Shenderov
(74) *Attorney, Agent, or Firm* — Workman Nydegger

(57) ABSTRACT

A flange includes: an attaching section to which a roll medium is attached; and an outer circumferential section that has a placing section and that assumes a first state and a second state into which the outer circumferential section is transformed from the first state and in which the placing section projects.

20 Claims, 15 Drawing Sheets

FLANGE, HOLDING DEVICE FOR HOLDING ROLL MEDIUM, AND RECORDING DEVICE FOR PERFORMING RECORDING ON ROLL MEDIUM

BACKGROUND

1. Technical Field

The present invention relates to a flange, a holding device for holding a roll medium, and a recording device for performing recording on a roll medium.

2. Related Art

Conventionally, flanges that are attached to a roll medium have been used. Further, a holding device capable of holding a roll medium by holding such flanges has been used. Furthermore, a recording apparatus including such a holding device has been used.

For example, JP-A-2013-112475 discloses movable flanges each capable of assuming a plurality of states with different forms, a holding device to which such flanges can be fitted, and a recording device to which such flanges can be fitted.

However, conventional flanges that are attached to a roll medium have problems in storing the roll medium. For example, when the flanges are removed from the holding device or the recording device with a roll medium attached to the flanges and are placed on a placement surface such as a floor, the roll medium may become damaged when it comes into contact with the placement surface, depending on the roll diameter of the roll medium. Further, for example, the roll medium may roll over together with the flanges.

The holding device disclosed in JP-A-2013-112475 is configured such that the flanges can be reduced in diameter in order to enable a roll medium to be fitted to the flanges. However, when the roll medium has a large roll diameter, the roll medium may make contact with the placement surface. Further, the holding device is not fully effective in suppressing rolling of the roll medium on the placement surface together with the flanges.

SUMMARY

An advantage of some aspects of the invention is to suppress problems in storing a roll medium.

A flange according to a first aspect of the present invention includes: an attaching section to which a roll medium is attached; and an outer circumferential section that has at least one placing section and that assumes a first state and a second state into which the outer circumferential section is transformed from the first state and in which the placing section projects.

According to the aspect, the flange may further include a lever connected to the placing section and movable with respect to the outer circumferential section. The outer circumferential section may be transformed from the first state into the second state as the lever moves.

According to the aspect, the flange may be configured such that the outer circumferential section is configured to be able to assume, as the second state, any of a plurality of states in which the placing section has different amounts of projection.

According to the aspect, the flange may be configured such that the outer circumferential section has a circular shape as viewed from an attaching direction in which the flange is attached to the roll medium.

According to the aspect, the flange may be configured such that: the outer circumferential section has a plurality of the placing sections and is provided with a plurality of slits the number of which is the same as the number of the placing sections; the lever is connected to each of the placing sections; and the outer circumferential section is transformed from the first state into the second state by causing the placing sections to project from the plurality of slits, respectively, as the lever moves.

A holding device according to a second aspect of the present invention includes a holding section that holds the flange according to the first aspect.

According to the aspect, the holding device may be configured such that the outer circumferential section assumes the first state when the flange is held by the holding section and assumes the second state when the flange has been removed from the holding section.

According to the aspect, the holding device may be configured such that: the flange includes a cam that is connected to the placing section and that moves by receiving an outside force, and is transformed from the second state into the first state by a movement of the cam; and the holding section includes an attaching and detaching section to and from which the flange is attached and detached. The holding device may be configured such that as the flange is attached to the attaching and detaching section, the cam moves to cause the flange to be transformed from the second state into the first state.

A recording device according to a third aspect of the present invention includes: a holding section that holds the flange according to the first aspect; and a recording section that performs recording on the roll medium held by the holding section.

BRIEF DESCRIPTION OF THE DRAWINGS

The invention will be described with reference to the accompanying drawings, wherein like numbers reference like elements.

DESCRIPTION OF EXEMPLARY EMBODIMENTS

A recording device serving as a holding device capable of holding a roll medium with the attachment of flanges according to an embodiment of the present invention is described below in detail with reference to the accompanying drawings.

Embodiment 1 (FIGS. 1 to 10)

Figure 1:
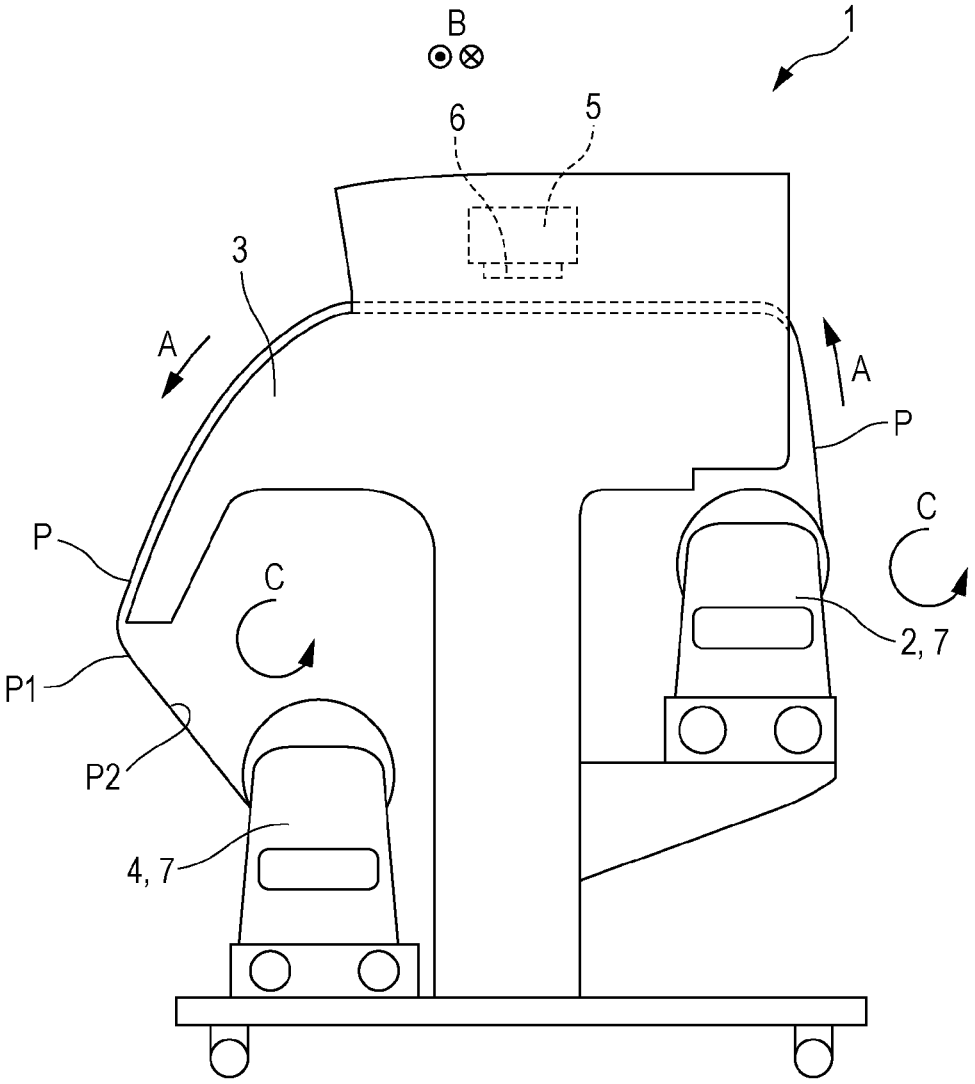
FIG. 1 is a schematic side view illustrating a recording device (holding device) including holding sections capable of holding a roll medium with the attachment of flanges according to Embodiment 1 of the invention.

FIG. 1 is a schematic side view illustrating a recording device 1 according to Embodiment 1.

As illustrated in FIG. 1, the recording device 1 according to Embodiment 1 includes a setting section 2 that serves as a holding section 7 capable of holding a roll recording medium (medium) P, a platen 3 that serves as a supporting section to support the recording medium P, and a rewinding section 4 that serves as a holding section 7 capable of rewinding the recording medium P into a roll and holding the recording medium P. The recording device 1 can transport the recording medium P in a transport direction A from the setting section 2 to the rewinding section 4 via the platen 3. That is, the recording device 1 transports the recording medium P along a transport path extending from the setting section 2 to the rewinding section 4, and the platen 3 is the supporting section provided in the transport path to support the recording medium P. The setting section 2 rotates in a direction of rotation C to feed out the recording medium P, and the rewinding section 4 rotates in the direction of rotation C to rewind the recording medium P. The direction of rotation C is a first direction of rotation. In the recording device according to Embodiment 1, the setting section 2 and the rewinding section 4, which serve as the holding sections 7, have the same configuration as each other.

It should be noted here that FIG. 1 illustrates a state in which the recording medium P has been set so that recording can be performed on a first surface P1 of the recording medium P. The first surface P1 is a surface of the recording medium P that faces outward as the recording medium P is rolled up. In this case, the setting section 2 rotates in the direction of rotation C. On the other hand, recording can also be performed on a second surface P2 of the recording medium P. The second surface P2 is a surface of the recording medium P that faces inward as the recording medium P is rolled up. In that case, the setting section 2 rotates in a direction of rotation opposite to the direction of rotation C.

Similarly, in FIG. 1, in which the rewinding section 4 according to Embodiment 1 is set up to rewind the recording medium P so that the first surface P1 faces outward, the rewinding section 4 rotates in the direction of rotation C. On the other hand, the rewinding section 4 can also rewind the recording medium P so that the first surface P1 faces inward. In that case, the rewinding section 4 rotates in a direction of rotation opposite to the direction of rotation C.

Further, the recording device 1 according to Embodiment 1 has a transporting section (not shown) provided in the transport path of the recording medium P. The transporting section includes a pair of rollers whose axes of rotation extend in a crosswise direction B crossing the transport direction A. This allows the recording device 1 according to Embodiment 1 to be configured such that, in the transport path of the recording medium 1, the transporting section transports the recording medium P fed out from the setting section 2 and the rewinding section 4 rewinds the recording medium P transported to the rewinding section 4 by the transporting section.

Further, the recording device 1 according to Embodiment 1 includes a recording head 6 as a recording section on a side of the transport path of the recording medium P opposite to the platen 3. The recording device 1 forms a desired image by causing the recording head 6 to eject ink through a nozzle-containing face of the recording head 6 while causing the recording medium P via a carriage 5 to reciprocate along the crosswise direction B. This configuration allows the recording head 6 to form the image by ejecting the ink onto the recording medium P.

Instead of including the recording head 6, which performs recording while reciprocating, the recording device 1 according to Embodiment 1 may include a so-called line head having a plurality of ink-ejecting nozzles provided along the crosswise direction B crossing the transport direction A.

The term "line head" here means a recording head that is provided so that the area of the nozzles formed along the crosswise direction B crossing the transport direction A of the recording medium P can entirely cover the recording medium P along the crosswise direction B and that is used in a recording device that forms an image by causing a relative movement of the recording head or the recording medium P. The area of the nozzles of the line head along the crosswise direction B does not need to be able to entirely cover all types of recording medium P that the recording device can handle along the crosswise direction B.

The recording section according to Embodiment 1 is the recording head 6, which can perform recording by ejecting the ink onto the recording medium P, but is not limited to such a component. For example, the recording section may be, for example, a transfer recording section.

Next, the holding sections 7, which serve as holding sections for holding the recording medium P, are described in detail. The holding sections 7 hold flanges 9 as well as the recording medium P. As such, the holding sections 7 serve both as holding sections for holding the recording medium P and as holding sections for holding the flanges 9.

Figure 2:
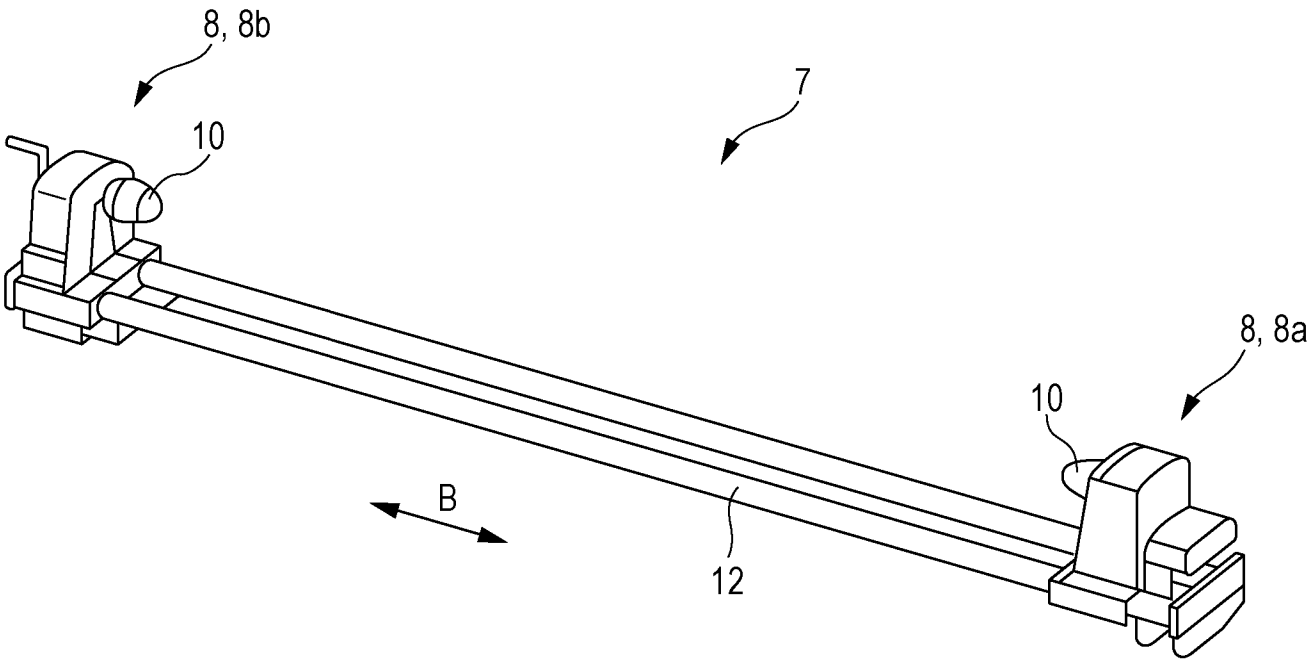
FIG. 2 is a schematic perspective view illustrating a holding section capable of holding a roll medium with the attachment of flanges according to Embodiment 1 of the invention.
Figure 3:
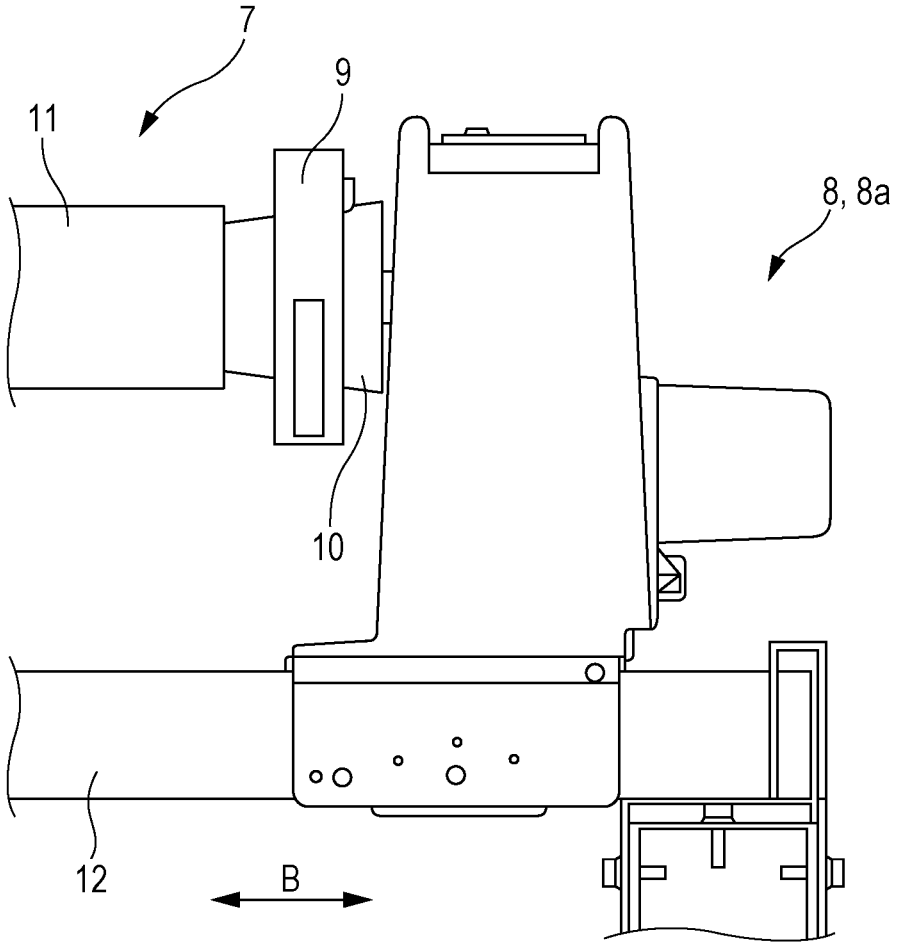
FIG. 3 is a schematic front view illustrating the holding section capable of holding a roll medium with the attachment of flanges according to Embodiment 1 of the invention.

FIGS. 2 and 3 are schematic views illustrating a holding section 7 according to Embodiment 1. Specifically, FIG. 2 is a perspective view of the holding section 7, and FIG. 3 is a front view of a part of the holding section 7, i.e., a fitting section 8*a* to which a roll recording medium P can be fitted via a flange 9.

Since the setting section 2 and the rewinding section 4 of the recording device 1 according to Embodiment 1 have the same configuration as each other, the holding section 7 of FIGS. 2 and 3 can be used both as the setting section 2 and as the rewinding section 4.

The holding section 7 according to Embodiment 1 includes fitting sections 8 each including an attaching and detaching section 10 to and from which a core 11 of a recording medium P can be attached and detached via flanges 9. Further, the fitting sections 8 includes fitting sections 8*a* and 8*b* provided at both ends of the holding section 7 in the crosswise direction B, respectively. The holding section 7 is configured to be capable of holding the recording medium P by moving the fitting sections 8*a* and 8*b* in the crosswise direction B along rails 12 and pressing both ends of the core 11 toward each other via the flanges 9 at the attaching and detaching sections 10 of the fitting sections 8*a* and 8*b*.

The recording device 1 according to Embodiment 1 can be rephrased as "a holding device including a holding section 7".

Next, a flange 9 according to Embodiment 1 is described.

Figure 4:
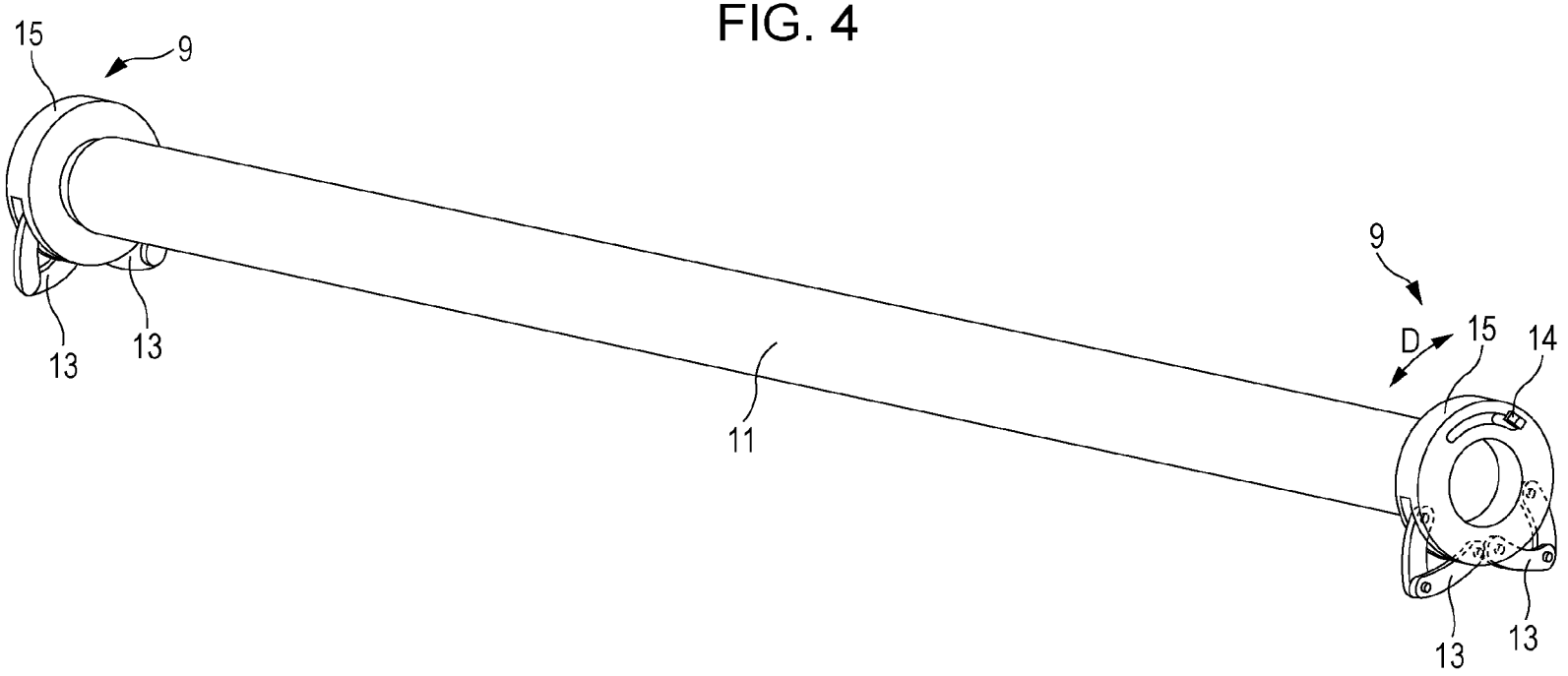
FIG. 4 is a schematic perspective view illustrating flanges according to Embodiment 1 of the invention.

FIG. 4 illustrates a state in which a core 11 with flanges 9 attached thereto has been removed from the recording device 1. Further, FIG. 5A illustrates a state in which a roll recording medium P is held by a holding section 7, and FIG. 5B illustrates a state in which the roll recording medium P has been removed from the holding section 7.

As illustrated in FIG. 4, each of the flanges 9 according to Embodiment 1 includes a lever 14. The lever 14 enables a user to put and take placing sections 13 into and out of an outer circumferential section 15 of the flange 9 by moving the lever 14 in directions of rotation D.

Figure 5A:
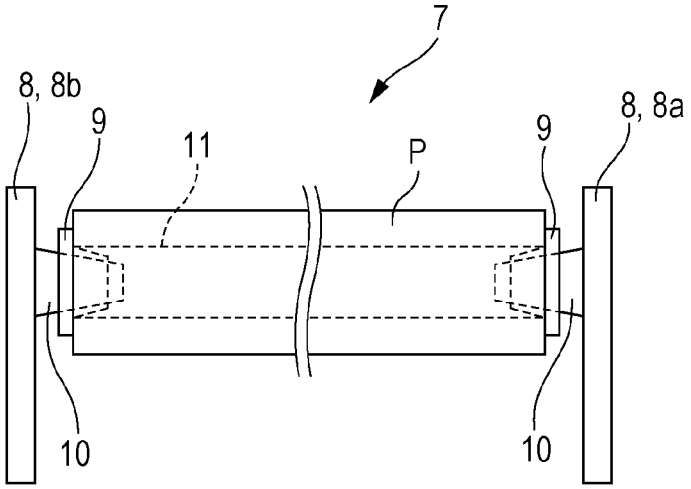
FIG. 5A is a schematic front view illustrating a holding section holding flanges according to Embodiment 1 of the invention whose outer circumferential sections are in a first state.

That is, in such a state as that illustrated in FIG. 5A where a roll recording medium P is held by a holding section 7, the user can bring about a first state in which the placing sections 13 do not project from the outer circumferential section 15 so that the flange 9 can smoothly rotate in the direction of rotation C during execution of recording.

Figure 5B:
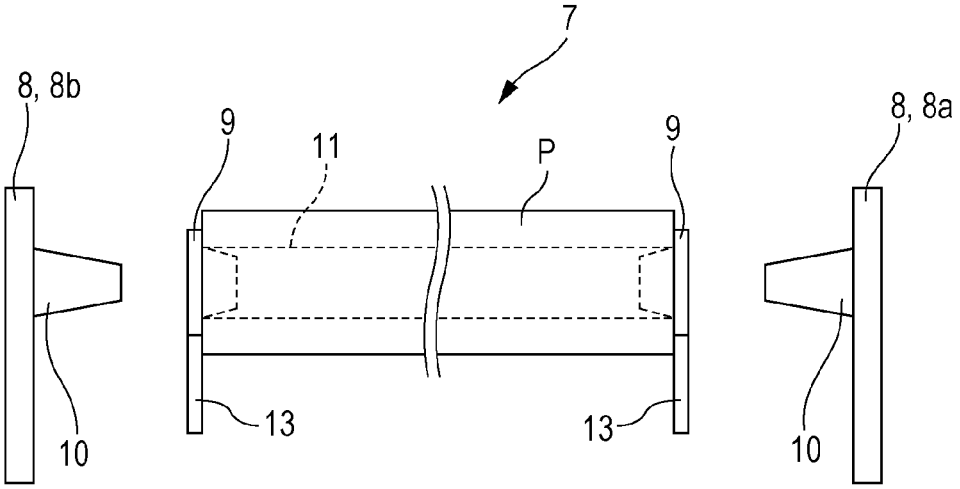
FIG. 5B is a schematic front view illustrating a holding section holding flanges according to Embodiment 1 of the invention whose outer circumferential sections are in a second state.

On the other hand, in such a state as that illustrated in FIG. 5B where the roll recording medium P has been removed from the holding device 7, the user can bring about a second state in which the placing sections 13 project from the outer circumferential section 15 to serve as legs so that the roll recording medium P can be stored without the occurrence of a problem.

The placing sections 13 are sections that make contact with a placement surface such as a floor when the flange 9 is placed on the placement surface.

Figure 15A:
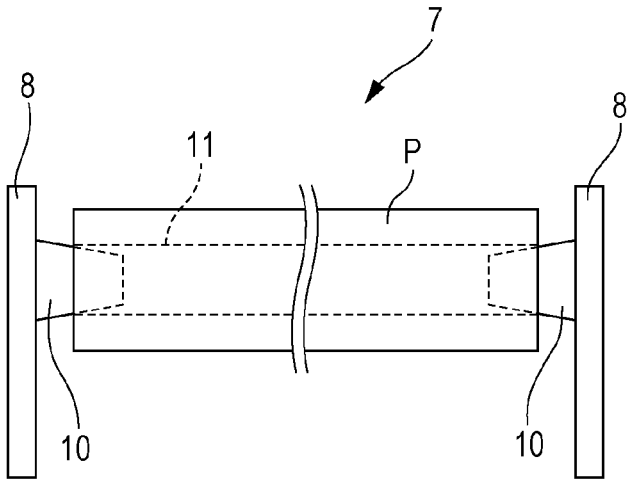
FIG. 15A is a schematic front view illustrating a conventional holding section capable of holding a roll medium.
Figure 15B:
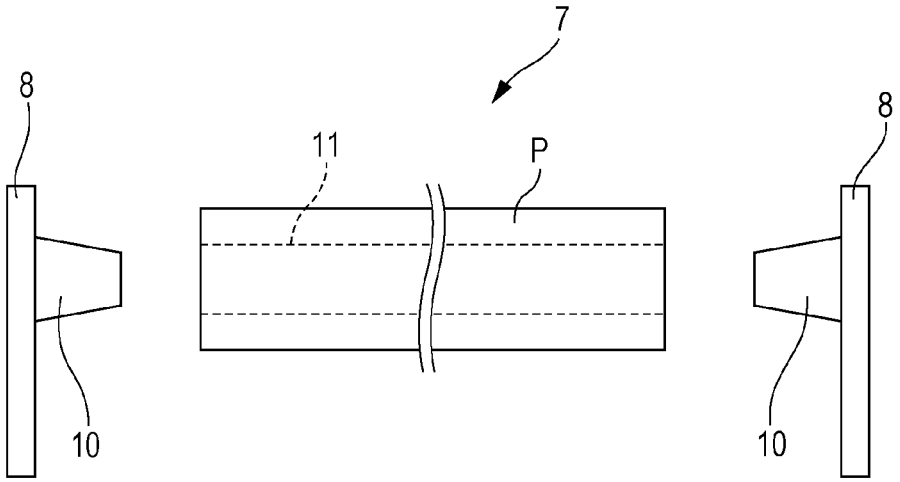
FIG. 15B is a schematic front view illustrating the conventional holding section capable of holding a roll medium.

FIG. 15A illustrates a state in which a roll recording medium P is held by a holding section 7 in a conventional recording device (holder-type holding device), and FIG. 15B illustrates a state in which the roll recording medium P has been removed from the holding section 7 in the conventional recording device.

The conventional recording device has been configured such that the roll recording medium P removed from the holding section 7 is placed with the first or second surface P1 or P2 of the recording medium P in contact with a placement surface such as a floor or that the roll recording medium P is placed in an upright position with an across-the-width side of the recording medium P in contact with the placement surface such as a floor so that the core 11 extends in a direction crossing the placement surface.

When placed with the first or second surface P1 or P2 in contact with the placement surface, the weight of the recording medium P may put pressure on the first or second surface P1 or P2, thus causing damage to an image that is formed on the recording medium P or deforming an image-forming surface of the recording medium P. Further, when placed in an upright position on the placement surface, the weight of the recording medium P may put pressure on a part of the recording medium P placed in contact with the placement surface, thus causing damage to the part or an area around the part.

On the other hand, including the flanges 9 according to Embodiment 1 makes it possible to store a recording medium P under no load as illustrated in FIGS. 4 and 5A.

Next, a structure of a flange 9 according to Embodiment 1 is described in detail.

Figure 6:
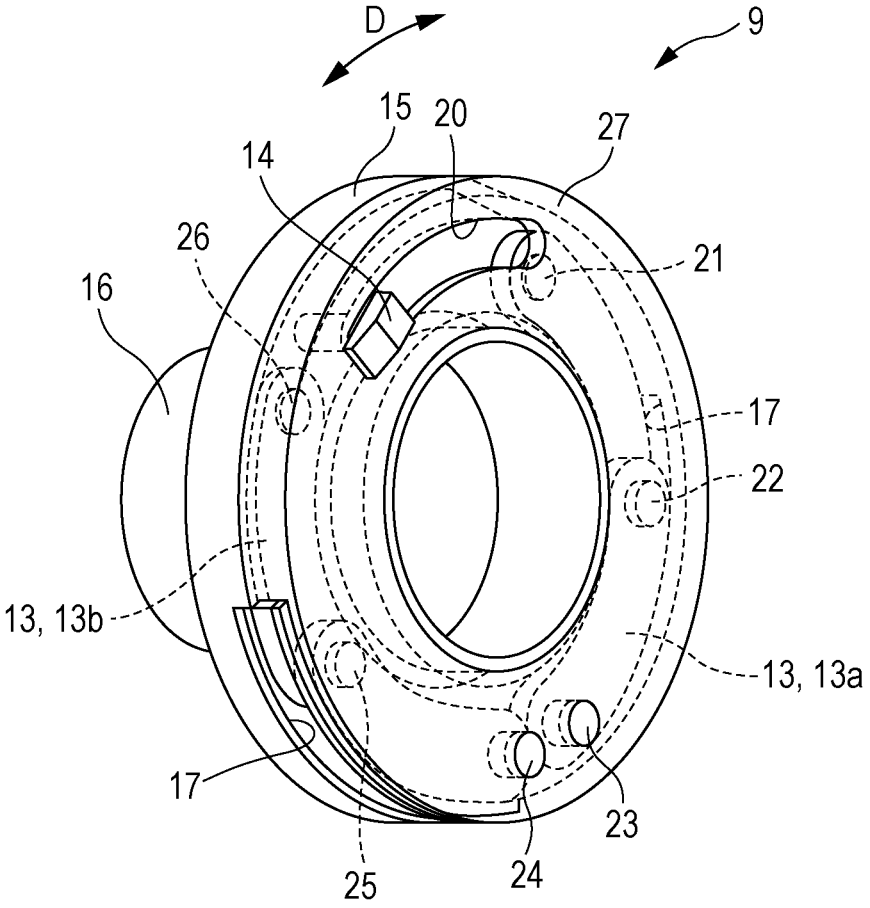
FIG. 6 is a schematic view illustrating a flange according to Embodiment 1 of the invention.
Figure 7:
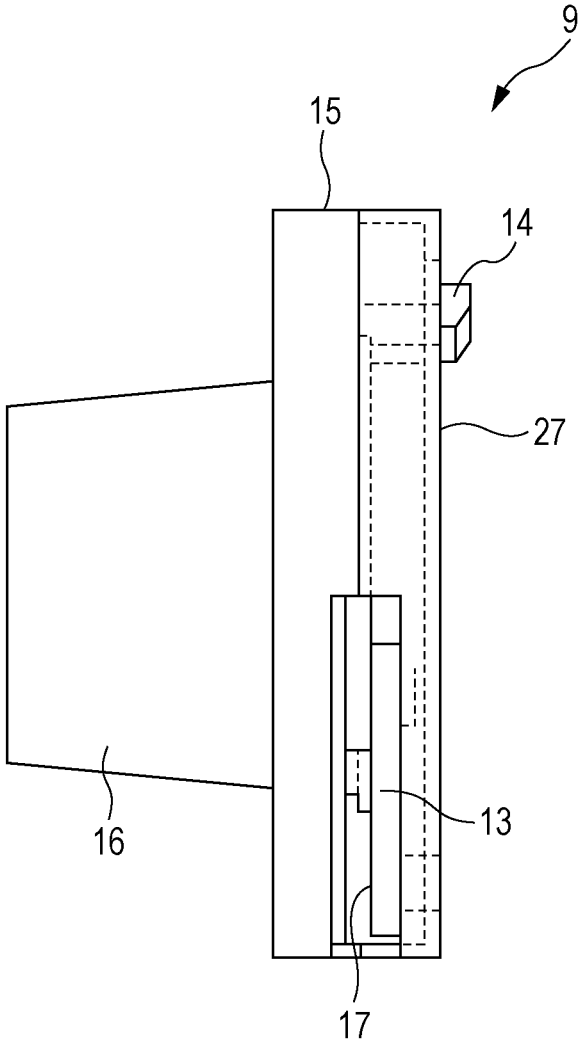
FIG. 7 is a schematic view illustrating the flange according to Embodiment 1 of the invention.
Figure 8:
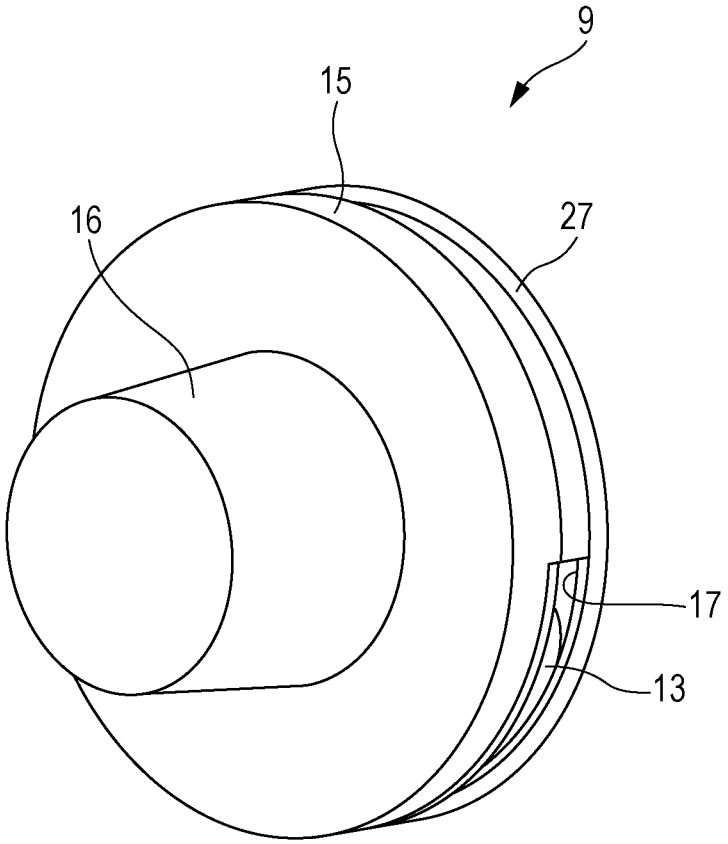
FIG. 8 is a schematic view illustrating the flange according to Embodiment 1 of the invention.
Figure 9A:
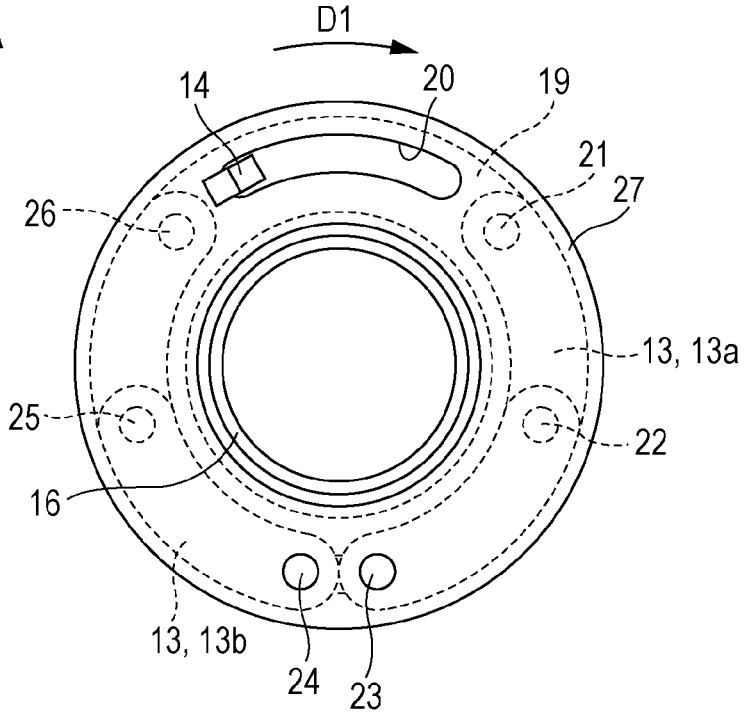
FIG. 9A is a schematic view illustrating a flange according to Embodiment 1 of the invention whose outer circumferential section is in the first state.
Figure 9B:
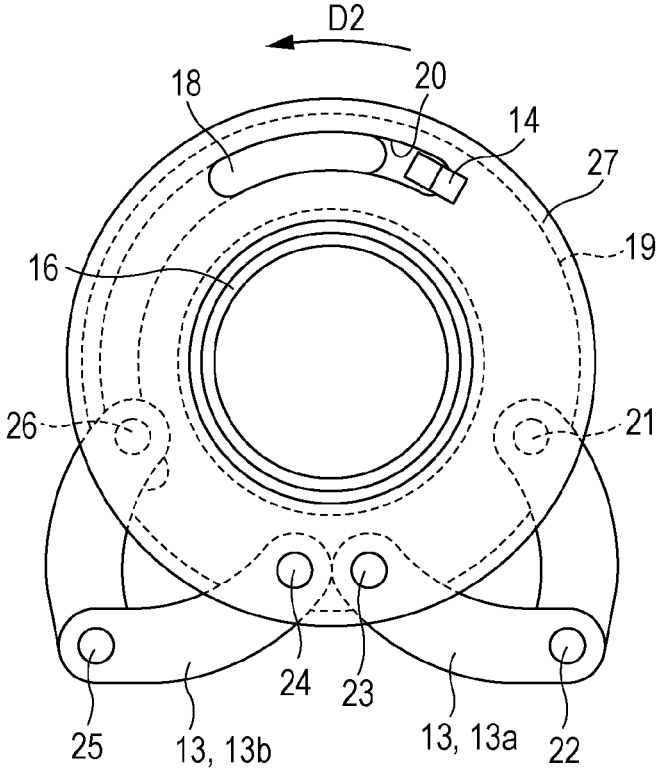
FIG. 9B is a schematic view illustrating a flange according to Embodiment 1 of the invention whose outer circumferential section is in the second state.
Figure 10:
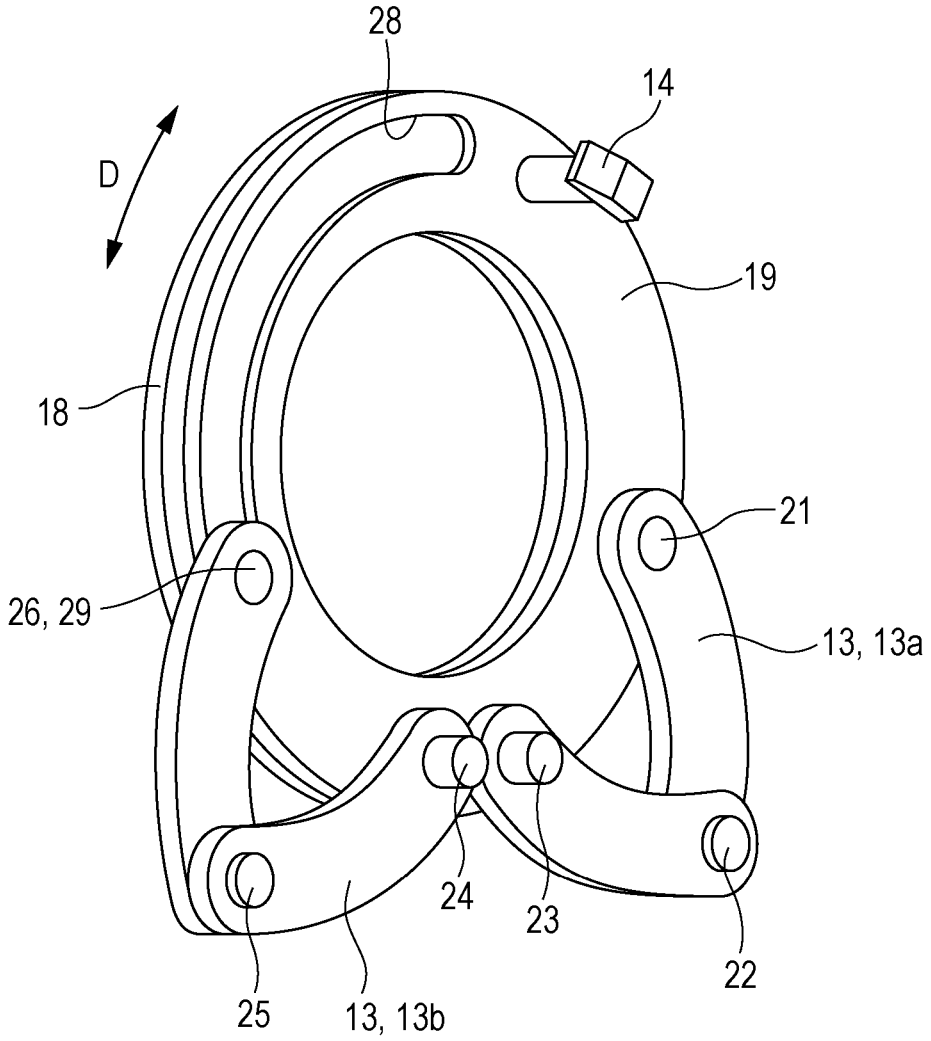
FIG. 10 is a schematic perspective view illustrating an internal structure of a flange according to Embodiment 1 of the invention.

FIGS. 6 to 8 are schematic views illustrating a flange 9 in which the placing sections 13 do not project from the outer circumferential section 15, i.e., whose outer circumferential section 15 is in the first state. Further, FIG. 9A is a schematic view illustrating a flange 9 whose outer circumferential section 15 is in the first state, and FIG. 9B is a schematic view illustrating a flange 9 in which the placing sections 13 project from the outer circumferential section 15, i.e., whose outer circumferential section 15 is in the second state. Further, FIG. 10 is a schematic view illustrating an internal structure of a flange 9.

The flange 9 according to Embodiment 1 is configured such that the first state of the outer circumferential section 15 is a state in which the placing sections 13 do not project from the outer circumferential section 15. Alternatively, the first state of the outer circumferential section 15 may be a state in which the placing sections 13 project from the outer circumferential section 15 and in which an amount of projection of the placing sections 13 from the outer circumferential section 15 is smaller than in the second state of the outer circumferential section 15.

As illustrated in FIGS. 6 to 8, the flange 9 according to Embodiment 1 includes a cylindrical member 27 that has the outer circumferential section 15 and an attaching section 16 to which the core 11 of a roll recording medium P is attached. Further, the outer circumferential section 15 is provided with slits 17 into and out of which the placing sections 13 can be put and taken by moving the lever 14 in the directions of rotation D. Moreover, putting the placing sections 13 into the slits 17 causes the outer circumferential section 15 to assume the first state in which the placing sections 13 do not project from the outer circumferential section 15, and taking the placing sections 13 out of the slits 17 causes the outer circumferential section 15 to assume the second state in which the placing sections 13 project from the outer circumferential section 15.

In other words, a flange 9 according to Embodiment 1 includes: an attaching section 16 to which a roll recording medium P is attached; and an outer circumferential section 15 that has placing sections 13 and that assumes a first state and a second state into which the outer circumferential section 15 is transformed from the first state and in which the placing sections 13 project. This configuration makes it possible to, by bringing the outer circumferential section 15 into the second state, suppress, for example, the roll recording medium P making contact with a placement surface and the flange 9 rolling on the placement surface. That is, this configuration makes it possible to suppress problems in storing the roll recording medium P.

Further, as illustrated in FIGS. 6, 9A, 9B, and 10, the placing sections 13 according to Embodiment 1 include placing sections 13*a* and 13*b*. The placing section 13*a* is connected to a cam 19, which is provided with the lever 14, at a connection 21, connected to the cylindrical member 27 at a connection 23, and configured to be able to be bent and stretched with a joint 22 as a pivot. The placing section 13*a* is connected to the cylindrical member 27 at a connection 24, connected to a cam 18 at a connection 26, and configured to be able to be bent and stretched with a joint 25 as a pivot.

For example, in the first state of the outer circumferential section 15 as illustrated in FIG. 9A, moving the lever 14 in a direction of rotation D1, which is one of the directions of rotation D, causes the placing section 13*a* to be bent with the joint 22 as a pivot and project from a corresponding one of the slits 17 and causes the placing section 13*b* to be bent with the joint 25 as a pivot and project from a corresponding one of the slits 17. This brings about the second state illustrated in FIG. 9B.

On the other hand, in the second state of the outer circumferential section 15 as illustrated in FIG. 9B, moving the lever 14 in a direction of rotation D2, which is the other of the directions of rotation D, causes the placing sections 13*a* and 13*b* to be stretched and stop projecting from the slits 17. This brings about the first state illustrated in FIG. 9A.

The placing sections 13 according to Embodiment 1 are configured to have the structure described above. However, the placing sections 13 according to Embodiment 1 are not limited to a particular configuration.

As illustrated in FIGS. 6, 9A, 9B, and 10, the cylindrical member 27 is provided with a slit 20 having an arc shape, and movements of the lever 14 in the directions of rotations D along the slit 20 cause the placing sections 13*a* and 13*b* to move into and out of the slits 17. Moreover, as illustrated in FIG. 10, the cam 19 is provided with a slit 28 having an arc shape, and the cam 18 has a protrusion 29 that constitutes the connection 26. The protrusion 29 moves in the directions of rotation D along the slit 28 as the lever 14 moves in the directions of rotation D along the slit 20.

As described above, the flange 9 according to Embodiment 1 includes the lever 14, connected to the placing sections 13, which can move with respect to the cylindrical member 27 (i.e., with respect to the outer circumferential section 15). This configuration allows the outer circumferential section 15 to be transformed from the first state into the second state as the lever 14 moves.

This enables the user to easily and manually transform the outer circumferential section 15 from the first state into the second state by moving the lever 14.

The lever 14 according to Embodiment 1 is configured to transform the outer circumferential section 15 from the first state into the second state by moving in the directions of rotation D1 along the slit 20. However, the lever 14 according to Embodiment 1 is not limited to such a configuration. For example, the lever 14 according to Embodiment 1 may move in directions different from the directions of rotation D with respect to the cylindrical member 27. Further, the lever 14 according to Embodiment 1 may move linearly.

Further, as described above, the flange 9 according to Embodiment 1 includes the plurality of placing sections 13*a* and 13*b*, thereby making it possible to more effectively suppress, for example, rolling of the flange 9 on the placement surface than in a case where the flange 9 includes a single placing section 13.

Further, as described above, the flange 9 according to Embodiment 1 is configured such that the placing section 13*a* is both connected to the cam 19 provided with the lever 14 and connected to the cylindrical member 27 and that the placing section 13*b* is both connected to the cam 18 and connected to the cylindrical member 27. That is, the lever 14 is directly or indirectly connected to each of the placing sections 13*a* and 13*b*, and the outer circumferential section 15 is transformed from the first state into the second state by causing the placing sections 13 to project from the plurality of slits 17, respectively, as the lever 14 moves. This configuration makes the transformation from the first state into the second state easier than does a configuration in which a plurality of levers 14 are separately provided for a plurality of placing sections 13.

Note, however, that without being limited to such a configuration, the lever 14 may be directly connected to the placing sections 13*a* and 13*b*.

It should be noted here that the flange 9 according to Embodiment 1 is configured such that the pressure (force of friction) with which the cams 18 and 19 and the cylindrical member 27 make contact with each other is adjusted to be an appropriate pressure and that the lever 14 can be fixed at any point in the slit 20. That is, the outer circumferential section 15 is configured to be able to assume, as the second state, any of a plurality of states in which each of the placing sections 13 has different amounts of projection.

This configuration makes it possible to assume the second state with an appropriate amount of projection according to the roll diameter of the roll recording medium P to be used. Note, however, that without being limited to such a configuration, the lever 14 may be configured to be able to be fixed at any of a plurality of particular points in the slit 20. Alternatively, the lever 14 may be configured to be able to be fixed only at one point in the slit 20.

Further, the flange 9 according to Embodiment 1 may be configured, as illustrated in FIGS. 9A and 9B, in which the flange 9 is viewed from an attaching direction in which the flange 9 is attached to the core 11 of a recording medium P, such that the outer circumferential section 15 has a circular shape as viewed from the attaching direction. This makes it possible to easily and efficiently rotate the flange 9.

In particular, the flange 9 according to Embodiment 1 can be effectively used, for example, in a holding device including a holding section 7 configured to hold the flange 9 at the outer circumferential section 15 and configured to feed out or rewind a roll medium P by rotating the outer circumferential section 15. The recording device 1 according to Embodiment 1 is configured such that each flange 9 is held by a holding section 7 by inserting the attaching section 16 into the attaching and detaching section 10. An example of a configuration in which the flange 9 is held at the outer circumferential section 15 is such a configuration as that illustrated in FIG. 2 in which two rails 12 are provided as a holding section to hold a flange 9 and in which a flange 9 to which a recording medium P has been attached is held by attaching the outer circumferential section 15 to the two rails 12.

Note, however, that without being limited to such a configuration, the outer circumferential section 15 may have, for example, an elliptical shape or a polygonal shape.

Embodiment 2 (FIGS. 11A to 14B)

Next, a flange 9 according to Embodiment 2 is described with reference to the accompanying drawings.

FIGS. 11A to 14B are schematic views illustrating a flange 9 according to Embodiment 2. Specifically, each of FIGS. 11A, 12A, 13A, and 14A illustrates the outer circumferential section 15 in the first state, and each of FIGS. 11B, 12B, 13B, and 14B illustrates the outer circumferential section 15 in the second state. The same components as those of the flange 9 according to Embodiment 1 are given the same reference numerals and, as such, are not described below.

As with the flange 9 according to Embodiment 1, the flange 9 according to Embodiment 2 can also be used in the recording device 1.

The flange 9 according to Embodiment 1 is configured such that the outer circumferential section 15 is transformed from the first state into the second state by a user manually moving the lever 14. On the other hand, the flange 9 according to Embodiment 2 is configured such that the outer circumferential section 15 can be automatically transformed from the first state into the second state as the flange 9 is removed from the attaching and detaching section 10 of the fitting section 8.

That is, the outer circumferential section 15 of the flange 9 according to Embodiment 2 assumes the first state when the flange 9 is held by a holding section 7 and assumes the second state when the flange 9 has been removed from the holding section 7.

This configuration makes it possible to automatically transform the outer circumferential section 15 into the first state by attaching the flange 9 to the holding section 7 and to automatically transform the outer circumferential section 15 into the second state by removing the flange 9 from the holding section 7.

As will be described in detail later, specifically, in a recording device 1 according to Embodiment 2, the flange 9 includes a cam 32 that is directly or indirectly connected to the placing sections 13 and that moves by receiving an outside force, and the flange 9 is transformed from the second state into the first state by a movement of the cam 32. Further, the holding section 7 includes an attaching and detaching section 10 to and from which the flange 9 is attached and detached. Moreover, the recording device 1 is configured such that as the flange 9 is attached to the attaching and detaching section 10, the cam 32 moves to cause the flange 9 to be transformed from the second state into the first state.

Thus configured, the recording device 1 according to Embodiment 2 makes it possible to automatically transform the outer circumferential section 15 into the first state by attaching the flange 9 to the holding section 7 and to automatically transform the outer circumferential section 15 into the second state by removing the flange 9 from the holding section 7.

A configuration of the flange 9 according to Embodiment 2 is specifically described.

As illustrated in FIGS. 11A to 12B, the flange 9 according to Embodiment 2 has its attaching section 16 provided with a protrusion 30. Further provided inside the attaching section 16 are a spring 31, the cam 32, and a cam 33. The spring 31 and a part of the cam 32 are located inside the protrusion 30.

Figure 11A:
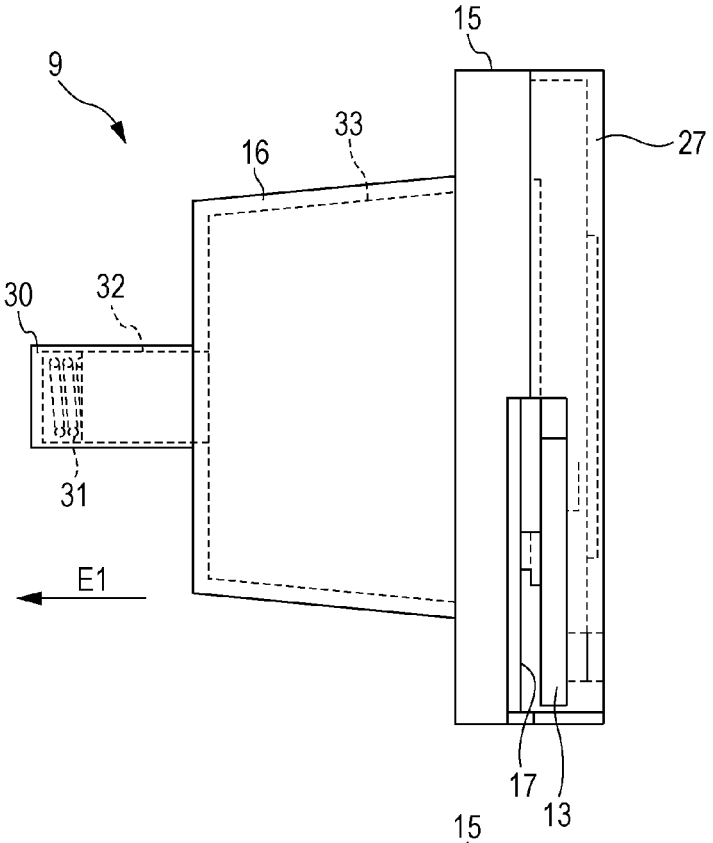
FIG. 11A is a schematic view illustrating a flange according to Embodiment 2 of the invention whose outer circumferential section is in the first state.
Figure 12A:
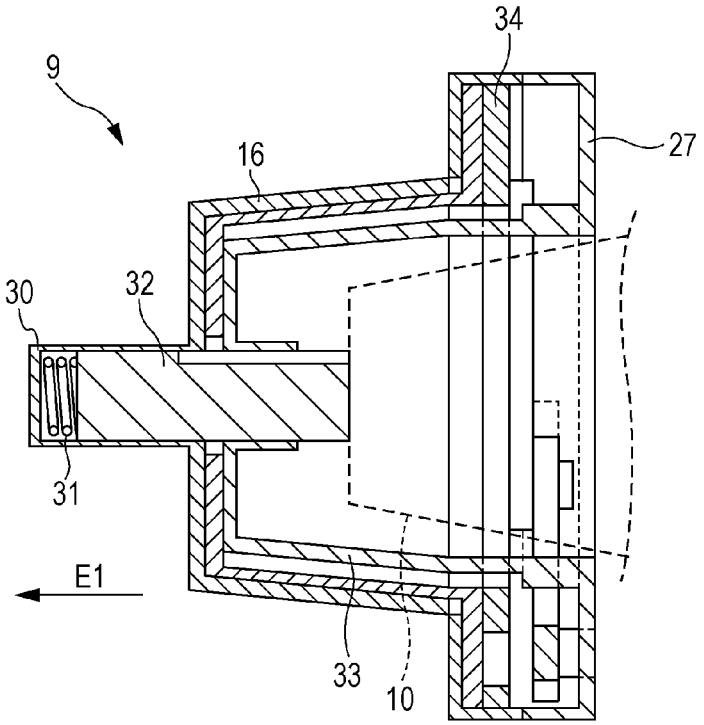
FIG. 12A is a schematic cross-sectional view illustrating a flange according to Embodiment 2 of the invention whose outer circumferential section is in the first state.

When the outer circumferential section 15 is in the first state as illustrated in FIGS. 11A and 12A, the attaching and detaching section 10 pushes the cam 32 in a direction E1, thereby causing the cam 32 to be located further forward in the direction E1 with respect to the cam 33.

Figure 11B:
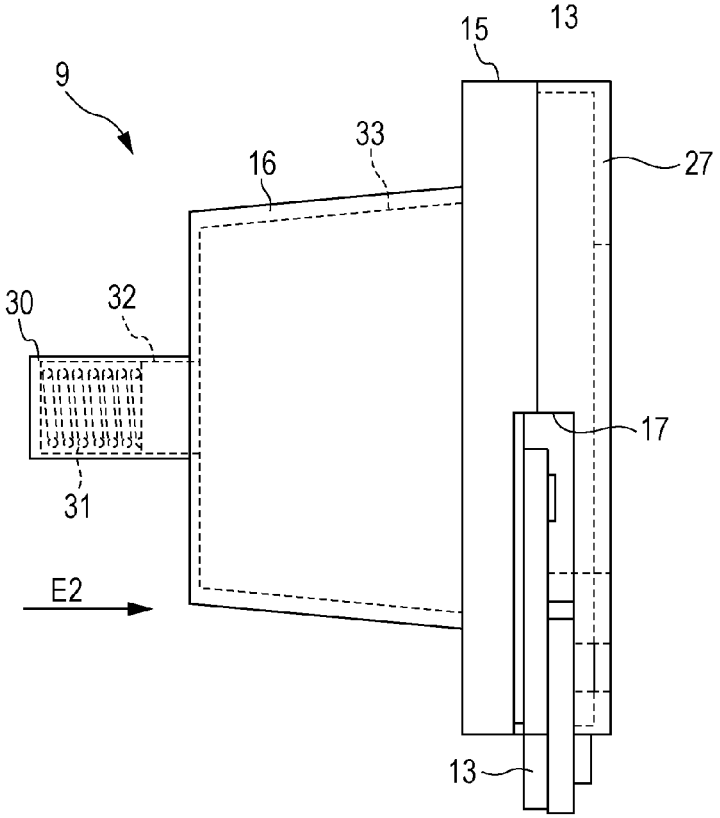
FIG. 11B is a schematic view illustrating a flange according to Embodiment 2 of the invention whose outer circumferential section is in the second state.
Figure 12B:
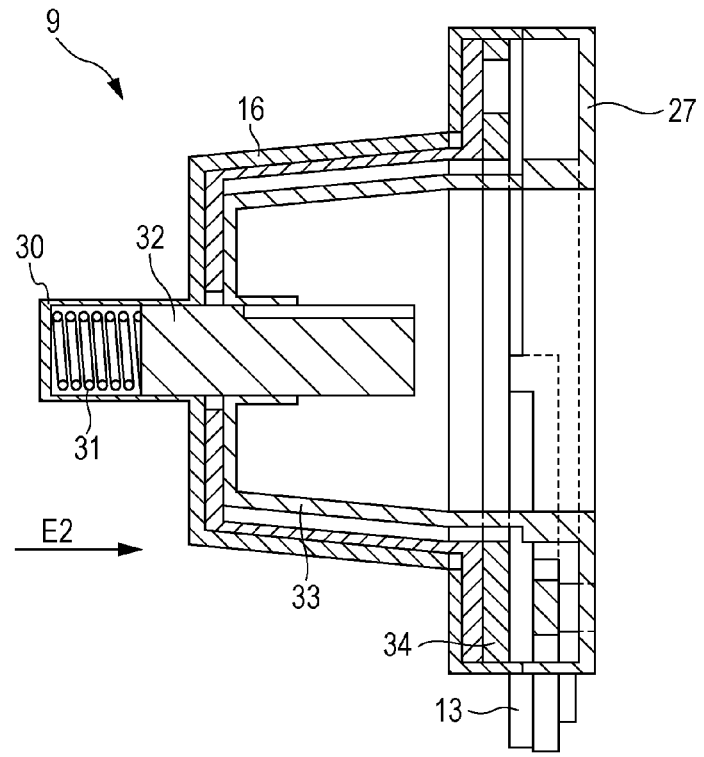
FIG. 12B is a schematic cross-sectional view illustrating a flange according to Embodiment 2 of the invention whose outer circumferential section is in the second state.

On the other hand, when the outer circumferential section 15 is in the second state as illustrated in FIGS. 11B and 12B, the spring 31 pushes the cam 32 in a direction E2, thereby causing the cam 32 to be located further forward in the direction E2 with respect to the cam 33.

Figure 13A:
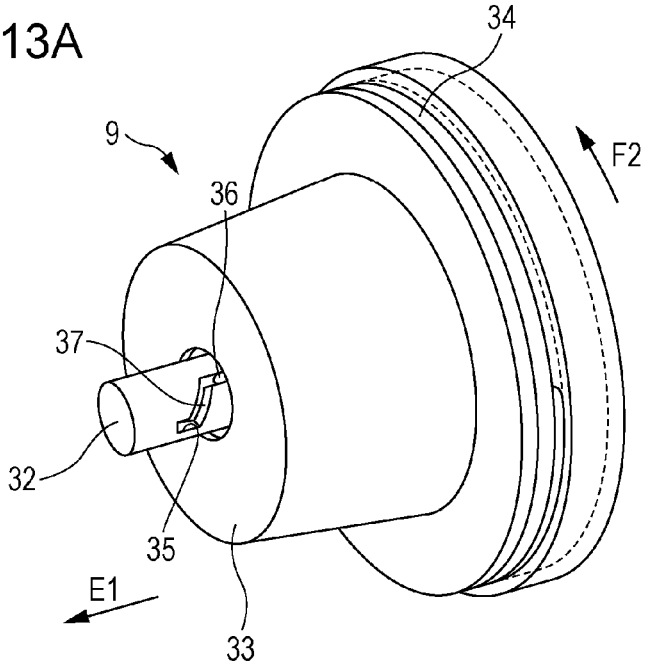
FIG. 13A is a schematic view illustrating an internal structure of a flange according to Embodiment 2 of the invention whose outer circumferential section is in the first state.

Further, as illustrated in FIG. 13A, the cam 32 includes a groove 35 having an oblique portion 37 extending in a direction at an oblique angle to the directions E1 and E2, and the cam 33 includes a protrusion 36 fitted in the groove 35.

Figure 13B:
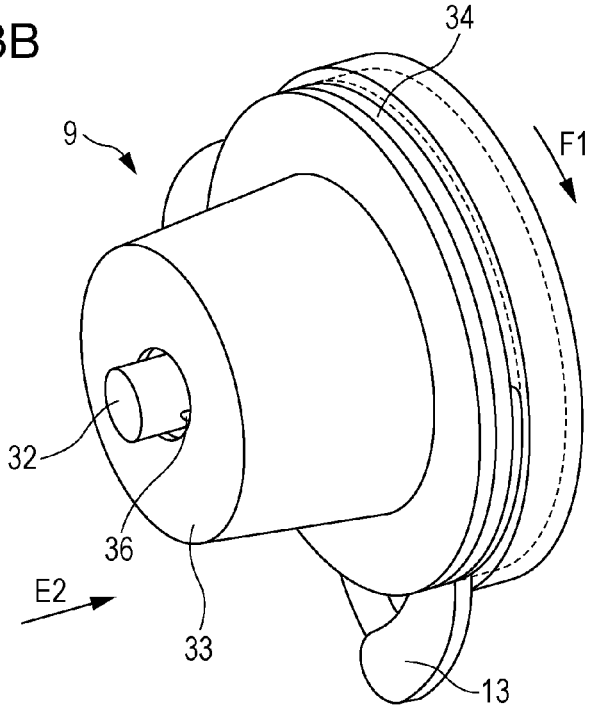
FIG. 13B is a schematic view illustrating an internal structure of a flange according to Embodiment 2 of the invention whose outer circumferential section is in the second state.

This configuration causes the cam 33 to move in a direction of rotation F1 with respect to the cam 32 when the cams 32 and 33 shift from the positional relationship of FIG. 13A to the positional relationship of FIG. 13B (i.e., when the cam 32 is pushed in the direction E2). The flange 9 according to Embodiment 2 also includes a cam 34, and the cam 33 has the same relationship with the cam 34 as that which the cam 18 has with the cam 19 in the flange 9 according to Embodiment 1. This causes the cam 34 to move in a direction of rotation F2 with respect to the cam 33 when the cam 33 moves in the direction of rotation F1 with respect to the cam 32.

Further, the cam 33 moves in the direction of rotation F2 with respect to the cam 32 when the cams 32 and 33 shift from the positional relationship of FIG. 13B to the positional relationship of FIG. 13A (i.e., when the cam 32 is pushed in the direction E1). Then, the cam 34 moves in the direction of rotation F1 with respect to the cam 33 as the cam 33 moves in the direction of rotation F1 with respect to the cam 32.

Figure 14A:
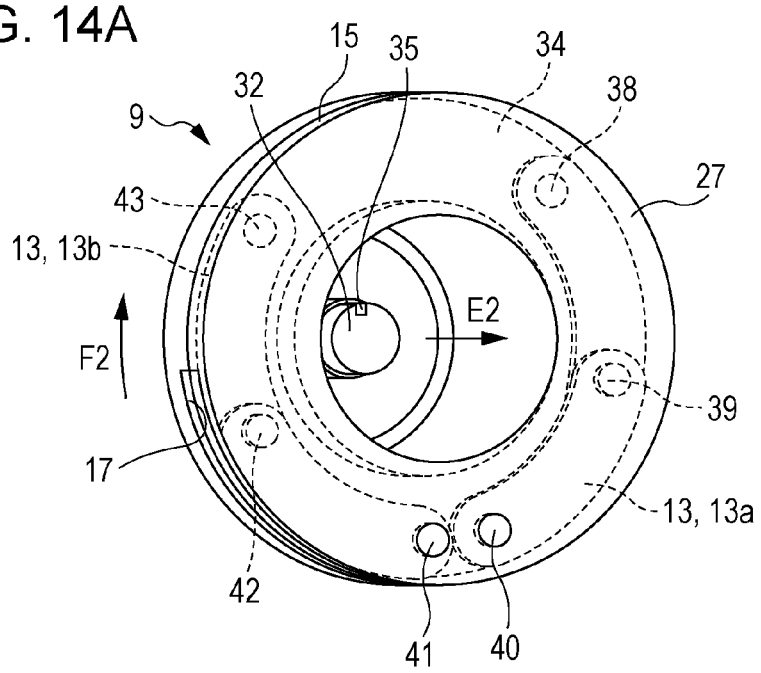
FIG. 14A is a schematic view illustrating a flange according to Embodiment 2 of the invention whose outer circumferential section is in the first state.
Figure 14B:
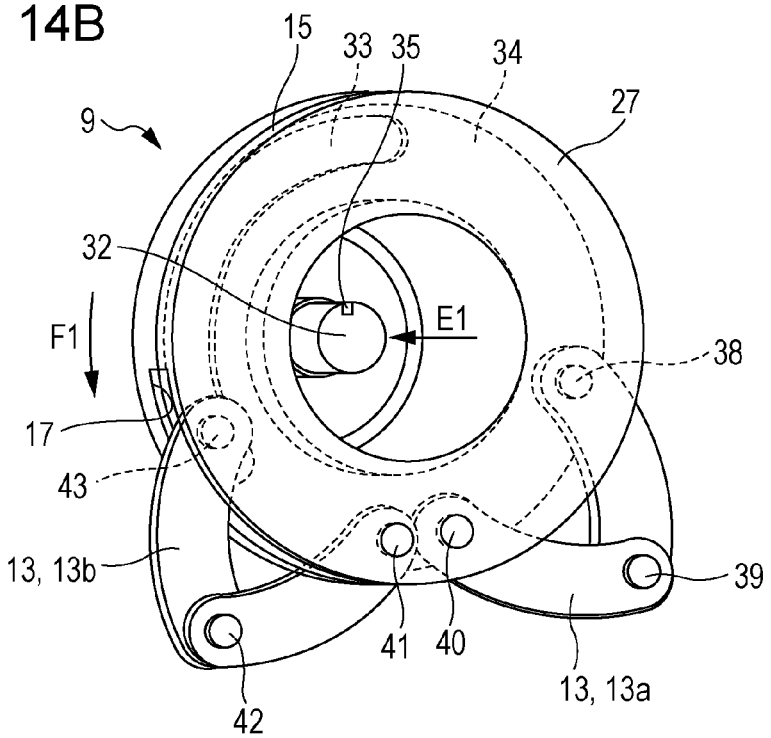
FIG. 14B is a schematic view illustrating a flange according to Embodiment 2 of the invention whose outer circumferential section is in the second state.

As illustrated in FIGS. 14A and 14B, the placing section 13 includes placing sections 13*a* and 13*b*. The placing section 13*a* is connected to the cam 34 at a connection 38, connected to the cylindrical member 27 at a connection 40, and configured to be able to be bent and stretched with a joint 39 as a pivot. The placing section 13*b* is connected to the cylindrical member 27 at a connection 41, connected to the cam 33 at a connection 43, and configured to be able to be bent and stretched with a joint 42 as a pivot.

In the first state of the outer circumferential section 15 as illustrated in FIG. 14A, a movement of the cam 32 in the direction E2 with respect to the cam 33 causes the placing section 13*a* to bent with the joint 39 as a pivot and project from the corresponding slit 17 and causes the placing section 13*b* to be bent with the joint 42 as a pivot and project from the corresponding slit 17. This brings about the second state illustrated in FIG. 14B.

On the other hand, in the second state of the outer circumferential section 15 as illustrated in FIG. 14B, a movement of the cam 32 in the direction E1 with respect to the cam 33 causes the placing sections 13*a* and 13*b* to be stretched and stop projecting from the slits 17. This brings about the first state illustrated in FIG. 14A.

The invention is not limited to the embodiments described above, but may be applied in many variations within the scope of the disclosure. Such variations are encompassed in the technical scope of the invention.

The invention has been described in detail above with reference to specific embodiments. The invention is summarized below.

A flange 9 according to a first aspect of the invention includes: an attaching section 16 to which a roll medium P is attached; and an outer circumferential section 15 that has at least one placing section 13 and that assumes a first state and a second state into which the outer circumferential section 15 is transformed from the first state and in which the placing section 13 projects.

The term "placing section" here means a section that makes contact with a placement surface such as a floor when the flange 9 is placed on the placement surface.

According to the first aspect, the outer circumferential section 15 assumes a first state and a second state into which the outer circumferential section 15 is transformed from the first state and in which the placing section 13 projects. This makes it possible to, by bringing the outer circumferential section 15 into the second state, suppress, for example, the medium P making contact with a placement surface and the flange 9 rolling on the placement surface. This in turn makes it possible to suppress problems when storing the roll medium P.

In the first aspect, a flange 9 according to a second aspect of the invention may further include a lever 14 connected to the placing section 13 and movable with respect to the outer circumferential section 15. The outer circumferential section 15 may be transformed from the first state into the second state as the lever 14 moves.

According to the second aspect, the flange 9 includes a lever 14 connected to the placing section 13 and movable with respect to the outer circumferential section 15. The outer circumferential section 15 is transformed from the first state into the second state as the lever 14 moves. This makes it possible to easily transform the outer circumferential section 15 from the first state into the second state by moving the lever 14.

In the first or second aspect, a flange 9 according to a third aspect of the invention may be configured such that the outer circumferential section 15 is configured to be able to assume, as the second state, any of a plurality of states in which the placing section 13 has different amounts of projection.

According to the third aspect, the outer circumferential section 15 is configured to be able to assume, as the second state, any of a plurality of states in which the placing section 13 has different amounts of projection. This makes it possible to assume the second state with an appropriate amount of projection according to the roll diameter of the roll medium P to be used.

In any one of the first to third aspects, a flange 9 according to a fourth aspect of the invention may be configured such that the outer circumferential section 15 has a circular shape as viewed from an attaching direction in which the flange 9 is attached to the roll medium P.

According to the fourth aspect, the outer circumferential section 15 has a circular shape as viewed from an attaching direction in which the flange 9 is attached to the roll medium P. This makes it possible to easily and efficiently rotate the flange 9.

In particular, the flange 9 according to the fourth aspect can be effectively used, for example, in a holding device 1 including a holding section 7 configured to hold the flange 9 at the outer circumferential section 15 and configured to feed out or rewind a roll medium P by rotating the outer circumferential section 15.

In the second aspect, a flange 9 according to a fifth aspect of the invention may be configured such that: the outer circumferential section 15 has a plurality of the placing sections 13 and is provided with a plurality of slits 17 the number of which is the same as the number of the placing sections 13; the lever 14 is connected to each of the placing sections 13*a* and 13*b*; and the outer circumferential section 15 is transformed from the first state into the second state by causing the placing sections 13 to project from the plurality of slits 17, respectively, as the lever 14 moves.

According to the fifth aspect, the outer circumferential section 15 has a plurality of placing sections 13*a* and 13*b*. This makes it possible to more effectively suppress, for example, rolling of the flange 9 on the placement surface than in a case where the outer circumferential section 15 has a single placing section 13.

Further, according to the fifth aspect, the lever 14 is connected to each of the placing sections 13*a* and 13*b*, and the outer circumferential section 15 is transformed from the first state into the second state by causing the placing sections 13 to project from the plurality of slits 17, respectively, as the lever 14 moves. This configuration makes the transformation from the first state into the second state easier than does a configuration in which a plurality of levers 14 are separately provided for a plurality of placing sections 13.

A holding device 1 according to a sixth aspect of the invention includes a holding section 7 that holds the flange 9 according to any one of the first to fifth aspects.

According to the sixth aspect, the holding device 1 includes a holding section 7 that holds a flange 9. This makes it possible to use a flange 9 capable of reducing problems when storing a roll medium P.

In the sixth aspect, a holding device 1 according to a seventh aspect of the invention may be configured such that the outer circumferential section 15 assumes the first state when the flange 9 is held by the holding section 7 and assumes the second state when the flange 9 has been removed from the holding section 7.

According to the seventh aspect, the outer circumferential section 15 assumes the first state when the flange 9 is held by the holding section 7 and assumes the second state when the flange 9 has been removed from the holding section 7. This makes it possible to automatically transform the outer circumferential section 15 into the first state by attaching the flange 9 to the holding section 7 and to automatically transform the outer circumferential section 15 into the second state by removing the flange 9 from the holding section 7.

In the seventh aspect, a holding device 1 according to an eighth aspect of the invention may be configured such that: the flange 9 includes a cam 32 that is connected to the placing section 13 and that moves by receiving an outside force, and is transformed from the second state into the first state by a movement of the cam 32; and the holding section 7 includes an attaching and detaching section 10 to and from which the flange 9 is attached and detached. The holding device 1 may be configured such that as the flange 9 is attached to the attaching and detaching section 10, the cam 32 moves to cause the flange 9 to be transformed from the second state into the first state.

According to the eighth aspect, the flange 9 includes a cam 32 that is connected to the placing section 13 and that moves by receiving an outside force, and is transformed from the second state into the first state by a movement of the cam 32. The holding section 7 includes an attaching and detaching section 10 to and from which the flange 9 is attached and detached. The holding device 1 is configured such that as the flange 9 is attached to the attaching and detaching section 10, the cam 32 moves to cause the flange 9 to be transformed from the second state into the first state. This configuration makes it possible to automatically transform the outer circumferential section 15 into the first state by attaching the flange 9 to the holding section 7 and to automatically transform the outer circumferential section 15 into the second state by removing the flange 9 from the holding section 7.

A recording device 1 according to a ninth aspect of the invention includes: a holding section 7 that holds the flange 9 according to any one of the first to fifth aspects; and a recording section 6 that performs recording on the roll medium P held by the holding section 7.

According to the ninth aspect, the recording device 1 includes a holding section 7 capable of holding a flange 9. This makes it possible to use a flange 9 capable of suppressing problems when storing a roll medium P.

The present invention makes it possible to suppress problems in storing the roll medium.

The entire disclosure of Japanese Patent Application No. 2014-207784, filed Oct. 9, 2014 is expressly incorporated by reference herein.

What is claimed is:

1. A flange, comprising:

an attaching section to which a roll medium is attached;

an outer circumferential section that has a larger diameter than a diameter of the attaching section; and a placing section provided on the outer circumferential section, the placing section assuming one of a first state in which the placing section does not project relative to an outer circumferential surface of the outer circumferential section and a second state in which the placing section projects outwardly relative to the outer circumferential surface.

2. The flange according to claim 1, further comprising a lever connected to the placing section and movable with respect to the outer circumferential section, wherein the placing section is transformed from the first state to the second state as the lever moves.

3. The flange according to claim 2, wherein:

the placing section includes a plurality of the placing sections and the outer circumferential section is provided with a plurality of slits from which the plurality of placing sections respectively project; and the lever is connected to each of the placing sections to move the plurality of placing sections from the first state to the second state.

4. A holding device for holding a roll medium, comprising a holding section that holds the flange according to claim 3.

5. A recording device comprising:

a holding section that holds the flange according to claim 3; and a recording section that performs recording on the roll medium held by the holding section.

6. A holding device for holding a roll medium, comprising a holding section that holds the flange according to claim 2.

7. A recording device comprising:

a holding section that holds the flange according to claim 2; and a recording section that performs recording on the roll medium held by the holding section.

8. The flange according to claim 1, wherein the second state includes a plurality of states in which the placing section projects outwardly in different lengths respectively.

9. A holding device for holding a roll medium, comprising a holding section that holds the flange according to claim 8.

10. A recording device comprising:

a holding section that holds the flange according to claim 8; and a recording section that performs recording on the roll medium held by the holding section.

11. The flange according to claim 1, wherein the outer circumferential section has a circular shape as viewed from an attaching direction in which the flange is attached to the roll medium.

12. A holding device for holding a roll medium, comprising a holding section that holds the flange according to claim 11.

13. A recording device comprising:

a holding section that holds the flange according to claim 11; and a recording section that performs recording on the roll medium held by the holding section.

14. A holding device for holding a roll medium, comprising a holding section that holds the flange according to claim 1.

15. The holding device according to claim 14, wherein the placing section assumes the first state when the flange is held by the holding section and assumes the second state when the flange has been removed from the holding section.

16. The holding device according to claim 15, wherein:

the flange includes a cam that is connected to the placing section and that moves by receiving an outside force, and the placing section is transformed from the second state into the first state by a movement of the cam; and the holding section includes an attaching and detaching section to and from which the flange is attached and detached, the holding device is configured such that as the flange is attached to the attaching and detaching section, the cam moves to cause the placing section to be moved from the second state into the first state.

17. A recording device, comprising:

a holding section that holds the flange according to claim 1; and a recording section that performs recording on the roll medium held by the holding section.

18. A flange, comprising:

an attaching section to which a roll medium is attached in an attaching direction;

an outer circumferential section that has a larger diameter than a diameter of the attaching section; and a placing section provided on the outer circumferential section, the placing section assuming one of a first state in which the placing section does not project from the outer circumferential section in a direction that intersects the attaching direction and a second state in which the placing section projects from the outer circumferential section in a direction that intersects the attaching direction.

19. A holding device for holding a roll medium, comprising a holding section that holds the flange according to claim 18.

20. A recording device, comprising:

a holding section that holds the flange according to claim 18; and a recording section that performs recording on the roll medium held by the holding section.

* * * * *